United States Patent [19]

Nishimura et al.

[11] Patent Number: 4,897,990

[45] Date of Patent: Feb. 6, 1990

[54] HIGHLY SHRINKABLE SUBSTANTIALLY ACRYLIC FILAMENT YARN

[76] Inventors: Makoto Nishimura, 2219, Omori-5-chome, Moriyama-ku, Nagoya; Takashi Nonaka, 1012, Kanare-1-chome, Meito-ku, Nagoya; Isao Uenishi, Taun Ishiodai 122-7, 2, Ishiodai-1-chome, Kasugai-shi; Tamotsu Goto, 4-1-607-103, Iwanaridai-8-chome, Kasugai-shi, all of Japan

[21] Appl. No.: 234,673

[22] Filed: Aug. 22, 1988

[30] Foreign Application Priority Data

Aug. 25, 1987 [JP] Japan ..... 62-210814

[51] Int. Cl.[4] ..... D02G 3/02

[52] U.S. Cl. ..... 57/247; 526/287; 526/330; 526/341

[58] Field of Search ..... 57/243, 247, 246, 288, 57/287; 526/341, 330, 287; 528/502; 428/369, 371

[56] References Cited

U.S. PATENT DOCUMENTS

| | | | |
|---|---|---|---|
| 3,878,178 | 4/1975 | Guinn et al. | 526/341 X |
| 3,972,174 | 8/1976 | London et al. | 57/247 X |
| 4,060,970 | 12/1977 | Talbot | 57/247 X |
| 4,067,948 | 1/1978 | Reinehr et al. . | |
| 4,100,725 | 7/1978 | Magel | 57/243 X |
| 4,108,845 | 8/1978 | Reinehr et al. . | |
| 4,140,844 | 2/1979 | Lohwasser | 526/341 |
| 4,256,684 | 3/1981 | Achard et al. . | |
| 4,421,708 | 12/1983 | Reichardt et al. | 526/341 X |
| 4,508,672 | 4/1985 | Reinehr et al. . | |

FOREIGN PATENT DOCUMENTS 150825 4/1978 United Kingdom .

*Primary Examiner*—Joseph J. Hail, III

*Attorney, Agent, or Firm*—Dowell & Dowell

[57] ABSTRACT

A highly shrinkable acrylic filament yarn which exhibits a degree of shrinking of at least 20% in boiling water, a maximum heat shrinking stress of at least 0.15 g/d in a dry heating atmosphere, and a Young's modulus of at least 280 Kg/mm$^2$ after free shrinking treatment in boiling water.

8 Claims, 2 Drawing Sheets

HIGHLY SHRINKABLE SUBSTANTIALLY ACRYLIC FILAMENT YARN

INDUSTRIAL APPLICATION FIELD

The present invention relates to highly shrinkable acrylic filament yarns which can be blended with other yarns or fabrics (forming twisted yarns, combined filament yarns, union woven fabrics, union knitted fabrics, or the like) to provide unique shape or pattern modifications.

PRIOR ART

Of conventional heat-shrinkable acrylic fibers, most representative are those for high-bulky spun yarn purposes, which are mass-produced and used industrially. These heat-shrinkable fibers are manufactured as follows: An acrylic polymer solution is subjected to wet spinning, the fiber is treated to remove the solvent therefrom and stretched in hot water at a draw ratio of 3:1 to 6:1. The resulting tows are oiled, dried at 120°–140° C. to remove water, baked to crush voids contained therein, and are crimped mechanically by a crimper, and the crimped tows are subjected to wet-heat relaxation and then stretched with wet-or dry-heating at a draw ratio of about 1.1:1.0 to 2.0:1.0 according to the heat shrinkability desired for the product fiber to have.

Productions of high-bulky spun yarns by making use of heat-shrinkable fibers are practiced by blending these fibers with non-shrinkable fibers to form single yarns or two folded yarns and subjecting the blended yarns to relaxing heat treatment to shrink the shrinkable fibers alone to make the whole yarn bulky. In this case, heat-shrinkable fibers at present are blended in proportions of about 40% while paying attention so as to achieve adequate degrees of fiber shrinkage (or adequate bulkiness of blended yarns) and the steadiness of fiber shrinkage when the blended yarns are subjected to shrinking heat treatment and so that the shrinked fibers may not be elongated by tensions which will be applied during various later processing steps. This means that it is an important factor besides the degree of heat shrinking in the characteristics of heat-shrinkable fibers to secure dimensional stability to heat shrinking stress and to the elongation due to external forces exerted after shrinkage. High-bulky spun yarns commonly used exhibit shrinkages in boiling water (hereinafter referred to as B.W.S.) of about 10 to 40%.

Spun yarns consisting of 100% of highly shrinkable acrylic fibers are also manufactured today and used as raw materials of other type twisted yarns, as core yarns of core spun yarns, and as others.

On the other hand, various raw materials are manufactured from acrylic filament yarns of the same type as the subject matter of the present invention by making use of their heat shrinkability. That is, heat-shrinkable acrylic filament yarns and non-shrinkable or low-shrinkable filament yarns are intermixed and used as blended twines or combined filament yarns with their morphological or functional features being exhibited. Being manufactured by continuous processes, heat-shrinkable acrylic filament yarns show lower BWS values than do heat-shrinkable acrylic staple yarns. Common BWS values of these conventional filament yarns are about 20% and even particularly higher values thereof are about 24–25%.

In almost all the cases where properties of heat-shrinkable fibers are represented, importance has hitherto been attached only to the heat shrinkage thereof and the degree of shrinking has been shown and utilized. In addition, developments of heat-shrinkable materials reported up to now have taken aim at the heat shrinking stress. For example, U.S. Pat. Nos. 4,108,845 and 4,508,672 and British Pat. No. 1,508,025 give no description on the heat shrinking stress but describe the degree of heat shrinking and U.S. Pat. No. 4,256,684 describes the heat shrinking stress but the value thereof is as low as 1215 mg/tex. ($\approx$0.135 g/d).

PROBLEMS TO SOLVE ACCORDING TO THE INVENTION

However, the heat shrinking stress is an important factor nearly equivalent to the degree of heat shrinking.

As an example, consider a case where a seersucker-like fabric is woven by using yarns of a highly shrinkable type as parts of the warp yarns and using yarns of a non-shrinkable or low-shrinkable type as all the weft yarns, wherein the warp yarns of each type are divided into groups consisting each of several yarns or tens of yarns and the groups of both-type warp yarns are arranged alternately, and then the fabric is subjected to shrinking-relaxing treatment in hot water. If the highly shrinkable warp yarns on shrinking treatment show low heat shrinking stress (e.q. the maximum value of dry-heat shrinking stress is about 0.1 g/d), this stress will not overcome binding force as well as processing tension which are exerted on the warp and weft yarns and hence the BWS of the highly shrinkable warp yarns will be less than the BWS of the whole yarn. Thus the bulkiness of the seersucker-like fabric will be unsatisfactory.

Another important property that shrinkable raw material yarns should have is dimensional stability or deformation resistance to external forces which will be exerted on the yarns after heat shrinking treatment thereof. That is, the stress-strain curve (S-S curve) for these yarns should be steep, in other words, it is ideal that these yarns are as close as possible to a low-elongation, high-tenacity type having a high Young's modulus. On the contrary, yarns of a high-elongation, low-tenacity type having a low Young's modulus tend to be elongated by external forces exerted longitudinally thereon. That is, in the fabric (woven fabrics, knitted fabrics, etc.) making step after shrinking heat treatment, the shrinked yarns will be extended or broken even by weak anomalous tension and therefore it will be impossible to apply such conditions as increased processing tension. These undesirable matters will arise.

For instance, in the above-mentioned seersucker-like expanded fabric, the heat-shrinked warp yarns will bear tension exerted longitudinally on the fabric after shrinking heat treatment thereof and if elongated by weak external force in the later step of sewing or wearing the product apparel, the fabric will not be usable. It is a matter of course that the heat-shrinked warp yarns need to resist sufficiently common external forces exerted on the fabric in the sewing step and in the wearing. Accordingly it is desirable that these yarns after heat shrinking have high Young's moduli.

Polyester filament yarns which can be readily provided with particularly high heat-shrinkability (40–60% BWS) exhibit S-S curves of a high elongation type, i.e. low Young's moduli, after treatment in boiling water. As the heat shrinkability is increased, this tendency becomes more remarkable and troubles are more liable to occur.

Another example is given below to show that problems arise when highly shrinkable acrylic fibers after treatment in boiling water have low Young's moduli. Core spun yarns (M.C (Metric Count) 1/20's, number of turns 160 T/M) were made by core spinning using spun yarns (M.C 1/52's, number of twist 680 T/M), as core yarns, consisting of 100% of a highly shrinkable acrylic fiber and using rovings in form of fleece consisting of a 5d×VC (variable cut) acrylic fiber (BWS 0–20%) as sheath yarns. These two folded core spun yarns were finished into hanks (300 g), which in turn were subjected to relaxing treatment with 100° C. steam for 30 minutes to form loop yarns having heat-shrinked yarns as core yarns, which were then coned up while waxing. The M.C of the two-folded core spun yarns on shrinking heat treatment changed from 2/20's to 2/12's. Since the M.C of spun yarns (M.C 1/52's) constructing each of the core spun has been changed from 2/52 to 2/30 by the two folding and the shrinking heat treatment, the 2/30's (M.C) yarn bears the whole tension exerted on the 2/12's (M.C) core spun yarn. When a plain stitch fabric is knitted from these textured yarns by using a 5-G flat knitting machine, it is necessary to knit the fabric in fine gauge in order to provide a higher-grade feel. The knitting in fine gauge results in an increase in the average knitting tension. When the knitting tension is varied by some cause, core yarns will break frequently or if not break, will stretch and become finer, resulting in fabrics of defective appearance.

BRIEF DESCRIPTION OF THE DRAWINGS

FIG. 1 shows relation between the maximum heat shrinking stress generated in highly shrinkable acrylic filament yarns and the BWS of fabrics woven by using these filament yarns for the warps, when the fabrics are subjected to relaxation treatment in boiling water.

FIG. 2 shows warp-directional elongations of fabrics under certain loads where highly shrinkable yarns different in Young's modulus after shrinking in boiling water are used severally as parts of the warps of the fabrics.

FIG. 3 shows stress-strain curves for a yarn of the present invention and a commercial spun yarn, before and after treatment in boiling water.

MEANS FOR SOLVING PROBLEMS

The present inventors made extensive studies with the object of providing heat-shrinkable yarns which exhibit high heat shrinkage and high heat shrinking stress, and after treatment in boiling water, have high Young's moduli. As a result the above object could be achieved with certain acrylic filament yarns. The present invention has been accomplished through the studies conducted by noting that acrylic fiber, dissimilar to polyester fiber or polyamide fiber that comprises a crystalline polymer, does not crystallize on thermal stretching even at considerably high temperatures, becuase of its internal fibrous structure, and therefore it may be easy to produce yarns from acrylic fiber which have high heat shrinkability and develop high heat shrinking stress.

The highly shrinkable acrylic filament yarn of present invention exhibits a BWS of at least 20%, preferably at least 27%; a maximum heat shrinking stress of at least 0.15 g/d, preferably at least 0.2 g/d, in a dry heating atmosphere; and it is of great importance for practical use that the Young's modulus of the present yarn after treatment in boiling water is at least 280 $Kg/mm^2$, preferably at least 320 $Kg/mm^2$. As stated above, the present inventive acrylic filament yarn has performance characteristics combining high heat shrinking stress with a high Young's modulus after boiling water treatment in addition to a higher heat shrinkability than a difinite value, for the purpose of exhibiting fully its heat shrink properties in fabric form. When the BWS is less than 20%, such yarns will be insufficient in the degree of heat shrinking itself for commercial articles even if exhibiting fully their heat shrinkability in fabrics. For practical use, the BWS is desirably at least 27%.

Heat shrinking stress is one of the important performance characteristics of the present inventive acrylic filament yarn (according to results of our studies). When the heat shrinking stress is about 0.1 g/d, such yarns cannot enough exhibit their heat shrinkability when subjected to shrinking heat treatment under the condition of composing a fabric wherein force binding warp yarns and weft yarns is strong, hence being difficult to provide the desired product. For practical use, the heat shrinking stress needs to be at least 0.15 g/d, particularly at least 2.0 g/d.

Figure 1:
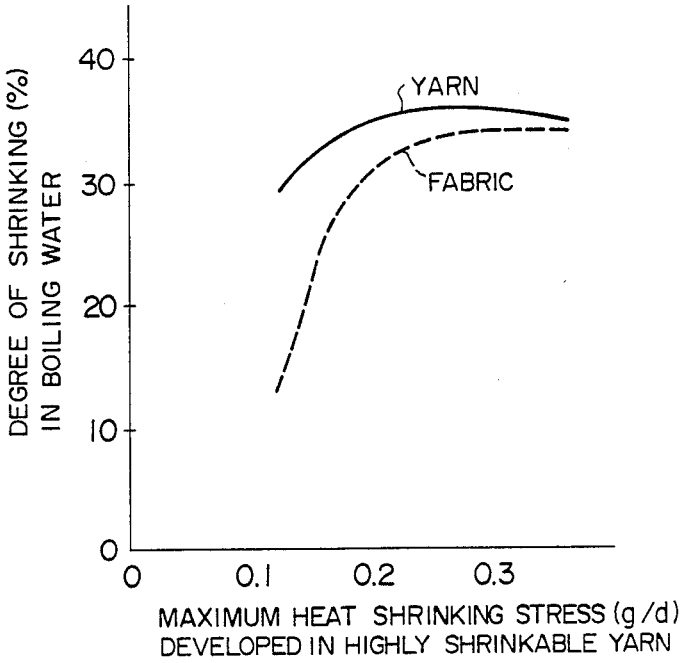
FIGS. 1, 2, and 3 are appended to explain the present invention with reference thereto.

FIG. 1 shows the relation between the maximum heat shrinking stress generated in highly shrinkable acrylic filament yarns and the BWS of fabrics woven by using these filament yarns for the warps, when the fabrics are subjected to relaxation treatment in boiling water. When the maximum heat shrinking stress is about 0.1 g/d, the BWS of the warp yarn is much lower than that of the same yarn in the free state. The maximum value exceeding 0.15 g/d will not be overcome by binding force exerted on the yarn in the fabric or by processing tension. When the maximum value is 0.2 g/d or higher, the BWS of the warp yarn is close to the BWS of the same yarn in the free state and hence such yarns in fabrics can be heat-shrinked sufficiently.

Desirable temperatures for the highly shrinkable acrylic filament yarn of the present invention to exhibit the maximum heat shrinking stress in a dry heating atmosphere are from 90° to 130° C. These temperatures are desirable for the purpose of shrinking the yarn sufficiently by allowing it to exhibit heat shrinking stress completely in normal-pressure steam treatment or hot water treatment, which is used for the heat shrinkage.

That is, a temperature, e.g. 130° C. where the heat shrinking stress in the dry heating atmosphere shows its maximum value corresponds to 100° C., where the heat shrinking stress in boiling water shows the maximum value. When the temperature where the heat shrinking stress in the dry heating atmosphere shows the maximum value exceeds 130° C., the heat shrinking stress in normal-pressure steam treatment or hot water treatment cannot reach the maximum value and therefore the shrinkage is insufficient. When the former temperature is below 90° C., the shrinkage takes place at too low temperatures, posing problems in handling.

The Young's modulus of a yarn after free shrinking treatment in boiling water is a characteristic value relating to the dimensional stability of the yarn in a free state and in the state of composing fabrics. Generally, heat shrinkable yarns after heat shrinkage tend to have lower Young's moduli. This is a disadvatage of those yarns and has been one of the worries in commercialization.

Yarns for fabrics are desired to have higher Young's moduli than a definite value, as a measure, for the fabrics to withstand accidental, anomalous external forces and maintain their dimensions steady in manufacturing steps such as the fabric making step and the sewing step and under wearing the resulting apparel. In particular, as is readily understable from the application state of highly shrinkable yarns, it is necessary to use higher proportions of highly shrinkable yarns in order to make such yarns or fabrics composed partly of highly shrinkable yarns as to withstand stronger external forces than the normal force exerted thereon, when the highly shrinkable yarns after boiling water treatment have a Young's modulus equivalent to that of the other component yarns. On the other hand, it is desirable to design freely the appearance change caused by heat-shrinking of yarns and fabrics composed partly of highly shrinkable yarns. For this purpose, even low blending ratios of highly shrinkable yarns are desired to raise no problem in practical use. Further, for this purpose, it is desirable that the highly shrinkable yarns after boiling water treatment have high Young's moduli; the higher Young's modulus the better. That is, the higher Young's modulus after boiling water treatment permits the more reducing the blending ratio of highly shrinkable yarn, and vice versa.

Figure 2:
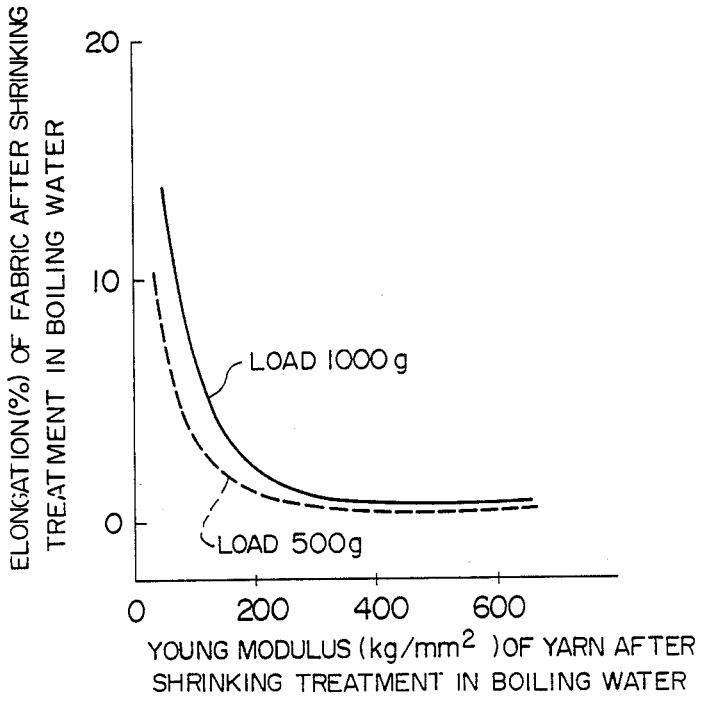

FIG. 2 shows warp-directional elongations of fabrics under certain loads where highly shrinkable yarns different in Young's modulus after shrink in boiling water are used severally as parts of the warps of the fabrics. That is, FIG. 2 shows data on fabrics having the following construction:

- Warp yarn: yarns formed by blending highly-shrinkable acrylic filament yarns of 75 d/60 f (blending ratio 20%) which show different Young's moduli after free shrinking heat treatment in boiling water and triacetate filament yarns of 75 d/20 f (blending ratio 80%) which show a BWS of 2% or less.
- Warp density: 85 ends/inch. Groups of 10 said acrylic filament yarns and groups of 40 said triacetate filament yarns are arranged alternately.
- Weft yarns: Triacetate filament yarns of 100 d/26 f which show a BWS of 2% or less.
- Weft density: 60 picks/inch.

Specimens of 2.54 cm width in the warp direction are taken from each fabric and the elongation of these specimens when loads of 1000 g and 500 g are applied per 2.54 cm width in the warp direction is shown as ordinate.

Various anomalous external forces may be exerted in steps of manufacturing the product and under wearing the product apparel and the values of such forces cannot be specified. Referring to FIG. 2, however, highly shrinkable yarns after boiling water treatment are desirable to have Young's moduli of at least about 200–250 Kg/mm$^2$, when an external force of 1000 g/inch width is exerted on the fabric, and have Young's moduli of at least about 150–200 Kg/mm$^2$, when an external force of 500 g/inch width is exerted on the fabric. When the exertion of an external force of 1000 g/inch width is foreseeable, it is necessary to increase the proportion of highly shrinkable yarns to use in the warp yarns if the Young's modulus of the highly shrinkable yarns after boiling water treatment is as low as 100 Kg/mm$^2$. Existing commercial highly shrinkable acrylic spun yarns of 1/52's (BWS 41%) and highly shrinkable polyester filament yarns of 75 d/24 f (BWS 43%), after boiling water treatment, have all Young's moduli of up to 100 Kg/mm$^2$, which are undesirable in resistance to deformation in manufacturing steps and under wearing the product apparel. In the case of highly shrinkable crimped yarns, the Young's modulus thereof after boiling water treatment tends to be 10–20% lower than that of corresponding straight yarns, on account of the buckling portions formed by crimping. Accordingly, the present inventors made extensive studies of the relationship between the Young's modulus of highly shrinkable yarns treated in boiling water and the deformation stability of yarns and fabrics formed from those highly shrinkable yarns. As a result it has been revealed that the Young's modulus after boiling water treatment is desirably at least 280 Kg/mm$^2$, preferably at least 320 Kg/mm$^2$, for highly shrinkable straight yarns and desirably at least 200 Kg/mm$^2$, preferably at least 250 Kg/mm$^2$ for highly shrinkable crimped yarns.

As to the present inventive highly shrinkable acrylic filament yarn subjected to false-twisting and crimping; the BWS is at least 20%, preferably at least 27%; the maximum heat shrinking stress in a dry heating atmosphere is at least 0.15 g/d, preferably at least 0.2 g/d; and the Young's modulus after free shrinking treatment in boiling water, as stated above, is at least 200 Kg/mm$^2$, preferably at least 250 Kg/mm$^2$.

The highly shrinkable acrylic filament yarn of the present invention can be colored by dyeing or other methods before use.

The heat shrinking stress is determined by fixing one end of a fiber specimen to be tested, connecting the other end of the specimen to a strain gage, hanging the specimen in loop form on both ends, fixing it with an initial load of 1/30 g/d, and heating the specimen-surrounding air continuously (heating rate: 100° C./min), during which the heat shrinking force is continuously measured. The heat shrinking stress at normal temperature is the initial tension alone. As the temperature is raised, the stress increases gradually and reaches the maximum at certain temperature, and thereafter the stress decreases with increasing temperature, thus showing a curve having said maximum. For this measurement, a tester, e.g. Model KET-1, supplied by Kanebo Engineering Co., Ltd., can be used.

The BWS is measured in accordance with JIS L-1073 (Test method for synthetic fiber filament yarn)-6.12. The outline of this method is that a yarn specimen is wound in 10 turns around a frame of 1-m circumference and the BWS is determined from the lengths of the specimen before and after 30 minutes' free shrinking treatment in boiling water.

The Young's modulus is measured in accordance with JIS L-1073 (Test method for synthetic fiber filament yarn)-6.10. The outline of this method is that the modulus is determined from the maximum tangent angle near the origin of a stress-strain curve drawn in accordance with JIS L-1070 (Tensile test method for filament yarn)-5.5.1.

A process for producing highly shrinkable acrylic filament yarns of the present invention is described below.

The raw material polymer used in the present invention is an acrylonitrile copolymer. Suitable solvents for dissolving this copolymer include dimethylformamide, dimethylacetamide, dimethylsulfoxide, aqueous thiocyanate solution, and aqueous nitric acid solution. The spinning may be carried out by any of dry, wet, and dry-jet-wet methods. Filaments formed thereby are freed of the solvent, stretched in a 80°–100° C. hot water bath or in normal pressure steam at a draw ratio of 2:1 to 4:1, dried at 110°-140° C., and if necessary, stretched at a draw ratio of 1.5:1 to 2.5:1 by using hot pins. Then these filaments are subjected to a relaxing heat treatment wherein the filaments are up to 50% shrinked by passing continuously over a 220°-270° C. hot metal plate. Further, these shrinked filaments are restretched at a draw ratio of 1.3:1 to 2.5:1 by using a 100°-150° C. hot metal plate, whereby intend highly shrinkable acrylic filament yarns can be obtained.

The above steps are explained below in more detail except the step of stretching with hot pins. The stretch in a hot water bath or in normal pressure steam is conducted desirably at a draw ratio of 2:1 to 4:1, because the stretchability is good under such conditions and such draw ratios permit achieving a higher degree of relaxation in the next step in connection with the composition of the acrylonitrile copolymer since the higher degree of relaxation by heating on a hot metal plate is the more desirable.

The next relaxation is conducted advantageously in normal pressure steam or on a hot metal plate. Since filament yarns, dissimilar to tows, are produced in continuous operation, the method of relaxation in high pressure steam requires a highly airtight mechanical device and this costs much money. When using a hot metal plate, it is necessary to maximize the degree of relaxation while maintaining constantly the hot plate temperature stable and uniform and keeping the filaments under uniform tension. Maximizing the degree of relaxation is for the purpose of achieving a high draw ratio in the next restretching step. For this purpose, the filaments are up to 50% shrinked by continuous heating at 220°-270° C. so as to achieve uniform and stable relaxation.

The rectretching step is very important. The draw ratio and temperature of the restretch are factors which govern the heat shrinkability of resulting filament yarns. Tension on the filaments during the restretch governs the value of heat shrinking stress. This restretch tension depends upon the draw ratio and temperature of the restretch. The Young's modulus of the resulting heat shrinkable yarn after boiling water treatment is governed by the temperature and tension of the restretch. The restretch is better carried out in a dry heating medium (hot air), wherein a high stretch tension can be provided more easily than in hot water or in steam and hence highly oriented yarns can be obtained. Thus, the restretch in hot air is preferred in the present invention.

The possible draw ratio in the restretch decreases with a decrease in the restretch temperature, that is, the possible draw ratio increase with an increase in the restretch temperature. In a low restretch temperature region, a high draw ratio cannot be achieved and hence highly shrinkable filament yarns cannot be produced. In a high restretch temperature region, a high draw ratio can be achieved but the BWS of the resulting filament yarn tends to be low. Desirably, the restretch is carried out within the range of 100° to 150° C.

For increasing the heat shrinking stress, it is important to increase the restretch tension while continueing the production so as to restretch the filaments uniformly and steadily without causing filament break. This effect of the restretch tension is an important fact which has been found out in the present inventive studies. The optimum draw ratio for the restretch in the dry heating atmosphere can be determined by measuring heat shrinking stress values at given temperatures while varying the restretch draw ratio so as to achieve the intended heat shrinking stress. Suitable draw ratios range from 1.3:1 to 2.5:1.

For the purpose of retaining the Young's modulus of the resulting heat shrinkable yarns after boiling water treatment, that is, for the purpose of retaining the Young's modulus at a value of at least 280 $Kg/mm^2$, preferably at least 320 $Kg/mm^2$, the temperature and tension of the restretch are varied within a range wherein the desired BWS of resulting filament yarns is obtainable and the Young's moduli of resulting filament yarns after boiling water treatment are measured to find out restretching conditions satisfying the intended value of said Young's modulus.

Suitable raw material polymers for use in the present invention are acrylonitrile copolymers containing at least 85% by weight of acrylonitrile. Comonomers which can be contained in this type of copolymer include; one or more ethylenic monomers, e.g. vinyl acetate, vinyl chloride, acrylic acid, and methacrylic acid; one or more carboxy-containing unsaturated compounds; and one or more sulfon-containing unsaturated compounds.

In the course of the process for producing the highly shrinkable acrylic filament yarn of the invention, filaments can be colored but this coloration is desirably conducted before the restretch step. The coloration may be carried out by any of generally used methods known to those skilled in the art; for instance, a colorant such as a pigment may be incorporated into the spinning liquid stock or filaments may be dyed by dip dyeing or spraying in a suitable production step.

The present inventive highly shrinkable acrylic filament yarns false-twisted and crimped are produced in the following manner:

The raw material polymer and the operating conditions of spinning, stretching, and thermal relaxation may be the same as in the above case of highly shrinkable acrylic filament yarns. In the subsequent restretch step, filaments are temporarily twisted and crimped while stretching. In this case, the intended filament yarns can be obtained by operating at a temperature of 100° to 150° C., a draw ratio of 1.3:1 to 2.5:1, and a twisting-side tension of 0.25 to 0.6 g/d (wherein d is the denier of filaments before restretch). This false-twisting and crimping may be carried out either continuously following the preceding step (the step of up to 50% shrinkage) or after once winding up around bobbins or the like.

EXAMPLES

The following examples illustrate the present invention in more detail.

EXAMPLE 1

An acrylonitrile copolymer constituted of 91 wt % of acrylonitrile, 8.7 wt % of vinyl acetate, and 0.3 wt % of sodium methacrylsulfonate, in dimethylacetamide, was subjected to dry-jet-wet spinning according to the ordinary method.

After removal of the solvent in a 70° C. hot water bath, the resulting yarn consisting of 60 filaments was stretched at a draw ratio of 3.5:1 in boiling water, dried in 120° C. hot air, subjected to relaxation treatment while 38% shrinking continuously over a 240° C. hot metal plate, and then restretched at a draw ratio of 2.0:1 and a speed of 125 m/min over a 135° C. hot metal plate, thus yielding a filament yarn of 100 d/60 f. The stretching tension in the restretch was 56 g/Yarn. Characteristic values of this filament yarn are shown below. The denier of this filament yarn after boiling water treatment was 155 d/60 f.

| | |
|---|---|
| Shrinkage in boiling water (BWS): | 35.6% |
| Maximum heat shrinking stress in hot air: | 0.23 g/d |
| Temperature giving above maximum value: | 107° C. |
| Young's modulus after free shrinking heat treatment in boiling water: | 490 Kg/mm$^2$ |

A plain pattern of fabric was woven by using this filament yarn and a low shrinkable acrylic yarn as the warp yarns, wherein groups of 10 highly shrinkable acrylic filament yarns and groups of 40 low shrinkable acrylic yarns were arranged alternately at a warp density of 80 ends/inch. The weft yarn used was a low shrinkable acrylic yarn (100 d/40 f) at a density of 60 picks/inch. The fabric was then subjected to shrinking relaxation treatment in a hot water bath (95° C.), yielding a seersucker-like bulky fabric having good appearance wherein the highly shrinkable yarn was greatly heat-shrinked.

Fabrics were woven under the same conditions by using yarns having characteristic values, as shown in the following table, departing from those of the present inventive yarn. Upon shrinking relaxation treatment as stated above, all the resulting fabrics (run Nos. 4, 5, and 6) showed insufficient heat shrinkage and low bulkiness.

| Yarn | Heat shrinking stress (g/d) | BWS (%) | Shrinkage (%) of fabric | Bulkiness |
|---|---|---|---|---|
| 1 Present invention | 0.23 | 35.6 | 31 | |
| 2 Present invention | 0.20 | 34.5 | 28 | |
| 3 Present invention | 0.15 | 32.0 | 20 | |
| 4 Yarn departing from scope of present invention | 0.13 | 29.5 | 13 | Δ |
| 5 Highly shrinkable acrylic spun yarn 1/80's | 0.08<br>0.08 | 49.3<br>49.3 | 10<br>10 | X<br>X |
| 6 Highly shrinkable polyester filament yarn 100 d/24 f | 0.13 | 42 | 16 | Δ |

Note: very good, good, Δ worse, X very worse

EXAMPLE 2

An acrylonitrile copolymer constituted of 90.5 wt % of acrylonitrile and 9.5 wt % vinyl acetate, in dimethylacetamide, was subjected to dry-wet spinning, according to the ordinary method.

After removal of the solvent in a 70° C. hot water bath, the resulting yarn consisting of 60 filaments was stretched at a draw ratio of 2.5:1 in boiling water, dried at 140° C., subjected to dry heat stretch at a draw ratio of 2.4:1 by using hot pins of 195° C. and then to relaxation treatment while 45% shrinking continuously over a 260° C. hot metal plate, and restretched at a draw ratio of 1.74:1 and a speed of 140 m/min over a 140° C. hot metal plate, thus yielding a filament yarn of 75 d/60 f. Such a draw ratio was determined that the stretching tension in the restretch at a hot metal plate temperature of 140° C. might be 52 g/Y. The found draw ratio was 1.74:1. Characteristic values of this filament yarn were as follows:

| | |
|---|---|
| BWS: | 32.4% |
| Maximum heat shrinking stress in hot air: | 0.34 g/d |
| Temperature giving above maximum value: | 108° C. |
| Young's modulus of filament yarn after boiling water treatment: | 570 Kg/mm$^2$ |

The maximum heat shrinking stress in boiling water was found to be 0.28 g/d.

EXAMPLE 3

A relaxed filament yarn prepared according to the procedure of Example 2 before the restretch step was restretched at a draw ratio of 1.74:1 and a speed of 120 m/min by using a false-twisting machine (Model LS-6, supplied by Mitsubishi Jukogyo Co., Ltd.) and the first heater alone at 140° C., yielding a yarn which exhibited much the same characteristic values as those of the yarn obtained in Example 2.

EXAMPLE 4

A relaxed filament yarn prepared according to the procedure of Example 2 before the restretch step was given a twist of 340 T/M, cheese-dyed according to the ordinary method (100° C.×30 minutes) with a cationic dye (Cathilon Brilliant Red 4GH, supplied by Hodogaya Chemical Co., Ltd.) to a concentration of 2% o.w.f., treated to deposit 3% o.w.f. of a finishing agent, and dried, giving a dyed yarn of 120 d/60 f. This dyed yarn was restretched under the same conditions as applied in Example 3, yielding a highly shrinkable yarn which exhibited characteristic values as follows:

| | |
|---|---|
| BWS: | 33.0% |
| Maximum heat shrinking stress in hot air: | 0.32 g/d |
| Temperature giving above maximum value: | 107° C. |
| Young's modulus of filament yarn after boiling water treatment: | 490 Kg/mm$^2$ |

EXAMPLE 5

A relaxed filament yarn of 200 d/60 f prepared according to the procedure of Example 1 before the restretch step was restretched and simultaneously twisted by using the false-twisting machine stated in Example 3 under the conditions: heater temperature 124° C., number of turns 1200 T/M, draw ratio 2.0:1, and processing speed 100 m/min, yielding a highly shrinkable yarn which exhibited characteristic values as follows:

| | |
|---|---|
| BWS: | 34.5% |
| Maximum heat shrinking stress in hot air: | 0.28 g/d |
| Temperature giving above maximum value: | 98° C. |
| Young's modulus of filament yarn after boiling water treatment: | 260 Kg/mm$^2$ |

EXAMPLE 6

A dyed filament yarn of 120 d/60 f prepared according to the procedure of Example 4 before the restretch step was restretched and simultaneously twisted by using the false-twisting machine stated in Example 3 under the conditions: heater temperature 120° C., number of turns 1400 T/M, draw ratio 1.6:1, and processing speed 100 m/min, yielding a highly shrinkable yarn which exhibited characteristic values as follows:

| | |
|---|---|
| BWS: | 32.5% |
| Maximum heat shrinking stress in hot air: | 0.27 g/d |
| Temperature giving above maximum value: | 94° C. |
| Young's modulus of filament yarn after boiling water treatment: | 360 Kg/mm$^2$ |

EXAMPLE 7

Figure 3:
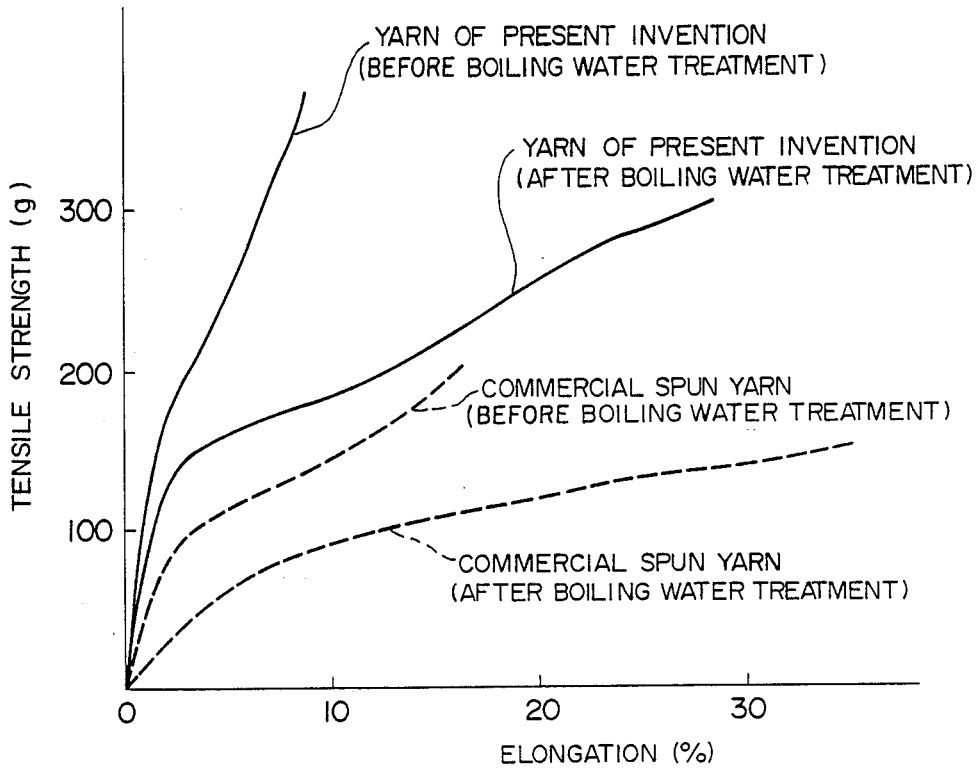

Characteristic values of an acrylic spun yarn consisting of 100% of a commercial highly shrinkable fiber were measured. The found values are shown below. Comparing this spun yarn with the present inventive yarn of Example 1, stress-strain curves for them were taken and changes of these curves by the free shrinking treatment of these yarns in boiling water were examined. Curves in FIG. 3 indicate that the present inventive yarn after free shrinking treatment in boiling water exhibited a high Young's modulus and was of a high tenacity, low elongation type, as compared with the commercial spun yarn.

| Commercial highly shrinkable acrylic spun yarn | |
|---|---|
| Count: | 1/80'$^5$ Nm |
| Number of turns: | 880 T/M |
| **Found characteristic values** | |
| BWS: | 40.5% |
| Maximum heat shrinking stress in hot air: | 0.074 g/d |
| Young's modulus after free shrinking treatment in boiling water: | 71 Kg/mm$^2$ |

COMPARATIVE EXAMPLE 1

An acrylonitrile copolymer having the same chemical composition as that of the copolymer used in Example 2 was extruded into a dimethylacetamide-water mixture to form filaments, which in turn were bundled into tows, which in turn were treated in a 70° C. water bath to remove the solvent. These tows were stretched at a draw ratio of 6:1 in boiling water, oiled, then dried in hot air at 120° C., and crimped mechanically. The tows, put in a container, were subjected to relaxing heat treatment in high pressure steam of 120° C. for 20 minutes. Then, the tows were restretched at a draw ratio of 2.0:1 in steam of 100° C., crimped again, and cut to prepare a raw stock staple of 1.2 d×51 mm. A yarn of 1/52's (M.C) and 650 T/M was spun from the raw stock by the staple spinning method. Characteristic values of this yarn are shown below.

| | |
|---|---|
| BWS: | 41% |
| Maximum heat shrinking stress in hot air: | 0.08 g/d |
| Young's modulus of yarn after boiling water treatment: | 63 Kg/mm$^2$ |

That is, although the BWS was high, the heat shrinking stress and the Young's modulus after boiling water treatment were lower than those which the present inventive yarn exhibited.

EFFECT OF THE INVENTION

The highly shrinkable acrylic filament yarn of the present invention, having such structure as described above, are superior in any of the degree of heat shrinking, heat shrinking stress, and Young's modulus after heat shrinking. Hence, the invention has the special effect providing superior yarns which can be used in combination with non-shrinkable or low-shrinkable fibers or yarns to produce fabrics having markedly-modified patterns and superior resistance to deformation.

The invention also other great effect such that highly shrinkable acrylic filament yarns provided with crimps can be produced by subjecting filaments under production to crimping and false-twisting simultaneously with restretching in the restretch step, without adding a new step.

Further, the invention has the following effect: In knitting processes such as circular knitting, straight filament yarns in the form of cones to be fed to circular machines are liable to become over-unwound and excess parts of the wound yarns tend to slip down from the yarn layers. This is liable to result in defective knitted fabrics. In contrast, the present inventive highly shrinkable filament yarns provided with crimps exhibit good knitting properties.

What is claimed is:

1. A highly shrinkable substantially acrylic filament yarn which exhibits a degree of shrinking of at least 20% in boiling water, a maximum heat shrinking stress of at least 0.15 g/d in a dry heating atmosphere, and a Young's modulus of at least 280 Kg/mm$^2$ after free shrinking treatment in boiling water.

2. The highly shrinkable substantially acrylic filament yarn of claim 1, which exhibits a degree of shrinking of at least 27% in boiling water, a maximum heat shrinking stress of at least 0.2 g/d in a dry heating atmosphere, and a Young's modulus of at least 320 Kg/mm$^2$ after free shrinking treatment in boiling water.

3. The highly shrinkable substantially acrylic filament yarn of claim 1, wherein the temperature giving the maximum heat shrinking stress in the dry heating atmosphere is from 90° to 130° C.

4. The highly shrinkable substantially filament yarn of claim 1, which is colored.

5. A highly shrinkable substantially acrylic filament yarn which exhibits a degree of shrinking of at least 20% in boiling water, a maximum heat shrinking stress of at least 0.15 g/d in a dry heating atmosphere, and a Young's modulus of at least 200 Kg/mm$^2$ after free shrinking treatment in boiling water and is provided with crimps and false twist.

6. The highly shrinkable substantially acrylic filament yarn of claim 5, which exhibits a degree of shrinking of at least 27% in boiling water, a maximum heat shrinking stress of at least 0.2 g/d in a dry heating atmosphere, and a Young's modulus of at least 250 Kg/mm$^2$ after free shrinking treatment in boiling water.

7. The highly shrinkable substantially acrylic filament yarn of claim 5, wherein the temperature giving the maximum heat shrinking stress in the dry heating atmosphere is from 90° to 130° C.

8. The highly shrinkable substantially acrylic filament yarn of claim 5, which is colored.

* * * * *

UNITED STATES PATENT AND TRADEMARK OFFICE

CERTIFICATE OF CORRECTION

PATENT NO. : 4,897,990

DATED : Feb. 6, 1990

INVENTOR(S) : Makoto Nishimura, et al

It is certified that error appears in the above-identified patent and that said Letters Patent is hereby corrected as shown below:

On the title page:

The Assignee has been omitted, should read:

--Mitsubishi Rayon Company, Limited--

The "Attorney, Agent, or Firm" is incorrect, should read:

--Oblon, Spivak, McClelland, Maier & Neustadt--

Signed and Sealed this

Nineteenth Day of March, 1991

*Attest:*

HARRY F. MANBECK, JR.

*Attesting Officer*

*Commissioner of Patents and Trademarks*